US007096671B2

(12) United States Patent
Bland et al.

(10) Patent No.: US 7,096,671 B2
(45) Date of Patent: Aug. 29, 2006

(54) CATALYTIC COMBUSTION SYSTEM AND METHOD

(75) Inventors: Robert Bland, Oviedo, FL (US); Ramarao V. Bandaru, Oviedo, FL (US); John Battaglioli, Scotia, NY (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 157 days.

(21) Appl. No.: 10/686,458

(22) Filed: Oct. 14, 2003

(65) Prior Publication Data

US 2006/0026964 A1 Feb. 9, 2006

(51) Int. Cl.
*F02C 7/22* (2006.01)
*F02C 7/26* (2006.01)

(52) U.S. Cl. ..... 60/777; 60/723; 60/39.822; 60/748

(58) Field of Classification Search ..... 60/777, 60/723, 737, 740, 746, 748, 39.822; 431/268, 431/326, 328, 170, 7, 353, 9, 115
See application file for complete search history.

(56) References Cited

U.S. PATENT DOCUMENTS 3,834,159 A * 9/1974 Vdoviak ..... 60/746
3,904,347 A * 9/1975 Rokudo et al. ..... 431/1
3,915,387 A * 10/1975 Caruel et al. ..... 239/400
4,598,553 A * 7/1986 Saito et al. ..... 60/733
4,926,645 A 5/1990 Iwai et al.
5,165,241 A * 11/1992 Joshi et al. ..... 60/737
5,228,847 A 7/1993 Lywood et al.
5,431,017 A * 7/1995 Kobayashi et al. ..... 60/723
5,452,574 A * 9/1995 Cowell et al. ..... 60/39.23
5,460,002 A 10/1995 Correa
5,593,299 A * 1/1997 Pfefferle ..... 431/170
5,613,363 A * 3/1997 Joshi et al. ..... 60/737
5,626,017 A * 5/1997 Sattelmayer ..... 60/723
5,720,609 A 2/1998 Pfefferle
5,729,967 A * 3/1998 Joos et al. ..... 60/39.6
5,899,075 A * 5/1999 Dean et al. ..... 60/737
5,996,333 A * 12/1999 Forestier et al. ..... 60/39.23
6,048,194 A 4/2000 Pfefferle et al.
6,095,793 A 8/2000 Greeb
6,122,916 A * 9/2000 Amos et al. ..... 60/747

(Continued)

FOREIGN PATENT DOCUMENTS

JP 58164930 A 9/1983

(Continued)

OTHER PUBLICATIONS

California Energy Commiccion, "Durability of Catalytic Combustion Systems," Consultant Report, Mar. 2002.

*Primary Examiner*—William H. Rodriguez

(57) ABSTRACT

Aspects according to the invention relate to a catalytic combustor system for a turbine engine and an associated method. Catalytic combustors are used in connection with turbine engines because they can minimize the formation of oxides of nitrogen during combustion. Despite this emissions advantage, catalytic combustion systems can increase the level of CO in the turbine exhaust. According to aspects of the invention, vortex formation devices includes vortex generators, swirlers and mixers can be placed downstream of each catalytic module surrounding the pilot nozzle so as to form one or more vortices in the otherwise substantially laminar flow exiting the modules. The vortices can create a suction so that a portion of the flow exiting the pilot nozzles is mixed with the flow exiting the catalyst modules. The introduction of the higher temperature pilot flow can accelerate the catalytic reaction time, promoting burnout of the CO formed during combustion.

12 Claims, 2 Drawing Sheets

U.S. PATENT DOCUMENTS 6,141,967 A * 11/2000 Angel et al. ..... 60/737
6,151,899 A * 11/2000 Park ..... 60/748
6,155,818 A 12/2000 Joshi et al.
6,223,537 B1 5/2001 Lipinski et al.
6,461,151 B1 10/2002 Knoepfel et al.
6,588,213 B1 * 7/2003 Newburry ..... 60/777
6,609,905 B1 * 8/2003 Eroglu et al. ..... 431/284
6,619,043 B1 * 9/2003 Bruck et al. ..... 60/723
6,625,988 B1 * 9/2003 Weisenstein et al. ..... 60/777
6,684,640 B1 * 2/2004 McMillan et al. ..... 60/737
6,708,498 B1 * 3/2004 Stickles et al. ..... 60/776
6,748,745 B1 * 6/2004 Ul Karim et al. ..... 60/777
6,810,670 B1 * 11/2004 Bruck et al. ..... 60/723
2002/0022204 A1 2/2002 Nagano et al.
2002/0182551 A1 12/2002 Carroni et al.
2003/0024234 A1 2/2003 Holm et al.
2003/0056511 A1 3/2003 Bruck et al.
2003/0056512 A1 * 3/2003 Bruck et al. ..... 60/723
2003/0205048 A1 * 11/2003 Hellat ..... 60/723

FOREIGN PATENT DOCUMENTS

JP 64-28421 3/1989

* cited by examiner

CATALYTIC COMBUSTION SYSTEM AND METHOD

FIELD OF THE INVENTION

The invention relates in general to turbine engines and, more particularly, to turbine engines having catalytic combustion systems.

BACKGROUND OF THE INVENTION

Turbine engines can include a variety of systems to minimize undesired emissions, such as oxides of nitrogen (NOx) and carbon monoxide (CO), generated during combustion. For example, some turbine engines use catalytic combustors to reduce the generation of NOx because catalytic combustion occurs at temperatures well below the temperature necessary for NOx production (above about 2700 degrees Fahrenheit). Catalytic combustion can occur at temperatures up to about 1000 degrees Fahrenheit to about 1400 degrees Fahrenheit. In contrast, conventional combustion temperatures can range from about 2500 to about 2900 degrees Fahrenheit.

While successful in combating NOx emissions, catalytic combustors can result in higher CO output from the engine, even at desired operating points such as base load. The increase in CO levels can be partly attributed to the lack of flame propagation in the relatively laminar or quiescent flow exiting the catalytic modules. The higher CO emissions are also a symptom of the relatively cold temperatures at which catalytic combustion occurs. The amount of time needed for CO burnout is largely a function of temperature. Because the temperature of the catalytic combustion reaction is relatively low, catalytic systems typically need more time to burn the CO. The longer burnout time in turn requires a combustion system having a sufficiently long travel path for the combustion gases to provide the requisite time for burnout before the gases leave the combustion system; however, due to packaging issues and economic feasibility, many engines cannot accommodate extra physical length. Thus, burnout takes longer than the distance (and travel time) available. Further, once they impinge on the first row of vanes in the turbine section, the combustion gases are quenched to about 400 degrees Fahrenheit, below the temperature needed to achieve CO burnout. Consequently, the unburned CO is passed in the engine exhaust.

The above problems can arise in almost any type of catalytic combustor system, including both lean and rich catalytic systems. Thus, there is a need for a turbine engine having a catalytic combustor system that is configured to reduce CO emissions.

SUMMARY OF THE INVENTION

Thus, one object according to aspects of the present invention is to provide a catalytic combustion system that can reduce CO emissions. Another object according to aspects of the present invention is to provide a catalytic combustion system configured to shorten flame lengths. Still another object according to aspects of the invention is to provide a catalytic combustion system that allows for the tuning of the shape of the flame so as to optimize system performance. Yet another object according to aspects of the invention is to allow for the use of catalytic combustion systems in connection a variety of turbine combustor systems. These and other objects according to aspects of the present invention are addressed below.

In one respect, aspects of the invention relate to a catalytic combustor system for a turbine engine. The system includes at least one pilot nozzle, at least one catalytic module and at least one vortex forming device. In one embodiment, the at least one catalytic module can substantially peripherally surround the pilot nozzle. Alternatively, the at least one pilot nozzle can substantially peripherally surrounds the catalytic module.

The at least one pilot nozzle provides a first flow existing the pilot nozzle. The at least one catalytic module provides a second flow exiting the plurality of catalytic modules. At least a portion of the second flow is substantially adjacent to at least a portion of the first flow. The at least one vortex forming device is positioned substantially within the path of the second flow. Thus, at least one vortex is formed in at least a portion of the second flow so as to cause at least a portion of the first flow to mix with at least a portion of the second flow. The first flow can be at least partially reacted, and the second flow can be partially reacted. Further, the second flow can be substantially laminar prior to encountering the vortex forming device.

The at least one vortex forming device can be a mixer, swirler or vortex generator. In one embodiment, the at least one vortex forming device can be positioned substantially adjacent to the exit of the at least one catalytic module. In another embodiment, the at least one vortex forming device can be positioned downstream of the at least one catalytic module. The at least one vortex forming device can include a plurality of surfaces. Each of the plurality of surfaces can be substantially oblique to the path of the second flow. In one embodiment, there can be at least two vortex formation devices. In such case, the at least two vortex formation devices can be different from each other. Thus, the combustion flame can be shaped according to the particular vortex formation devices selected.

In another respect, aspects of the invention relate to a method for reducing CO emissions in a catalytic combustor for a turbine engine. According to this method, a turbine engine is provided having a catalytic combustor system, which includes a catalytic combustor with at least one pilot nozzle and at least one catalytic module. A first mixture of fuel and air is passed through the at least one catalytic module such that a catalyst is introduced to the first mixture. The catalyst commences a combustion reaction with the mixture. The flow exiting each of the catalytic modules forms a catalytic flow stream having a catalytic temperature.

A second mixture of fuel and air is passed through the pilot nozzle such that at least a portion of the second mixture is ignited. The flow exiting the pilot nozzle forms a pilot flow stream having a pilot temperature. The pilot temperature is greater than the catalytic temperature. The pilot flow stream and the catalytic flow stream are ducted away from the at least one pilot nozzle and the at least one catalytic module. As they are ducted away, the pilot flow stream and the catalytic flow stream remain substantially unmixed. In one instance, the catalytic flow stream can substantially peripherally surround the pilot flow stream.

At least one vortex is created in at least a portion of the catalytic flow stream. The at least one vortex in the catalytic flow stream causes at least a portion of the pilot flow stream to mix with at least a portion of the catalytic flow stream. Consequently, the hotter pilot flow stream accelerates the burnout reaction in the catalytic flow stream and further shortens the combustion flame length so as to reduce carbon monoxide emissions from the turbine engine.

The at least one vortex can be created by providing a vortex forming device that is positioned substantially within the catalytic flow stream. In one embodiment the at least one vortex forming device is provided substantially at the exit of at least one of the catalytic modules. The at least one vortex can be created by one of vortex generators, mixers, or swirlers. When it mixes with at least a portion of the pilot flow stream, the catalytic flow stream can be partially reacted. Further, the pilot flow stream can be at least partially reacted when it mixes with at least a portion of the catalytic flow stream.

The step of creating at least one vortex includes imparting bulk motion in the catalytic flow stream. In one embodiment, at least a first vortex and a second vortex are formed within the catalytic flow stream, the first vortex being substantially different from the second vortex. Thus, the vortices can be used to selectively shape the combustion flame.

In yet another respect, aspects of the invention relate to a catalytic combustion method for a turbine engine. According to this method, a substantially laminar catalytic flow stream is provided. The catalytic flow stream has a catalytic temperature. The catalytic flow stream is partially reacted by a catalyst in the catalytic flow stream.

An at least partially reacted pilot flow stream at a pilot temperature is provided. The pilot temperature is greater than the catalytic temperature. At least a portion of the pilot flow stream travels substantially adjacent to at least a portion of the catalytic flow stream. The catalytic and pilot flow streams remain substantially unmixed. Secondary motion is generated in at least a portion of the catalytic flow stream such that at least a portion of the catalytic flow stream mixes with at least a portion of the pilot flow stream. As a result, the hotter pilot flow stream accelerates the burnout reaction in the catalytic flow stream and further shortens the combustion flame length so as to reduce carbon monoxide emissions from the turbine engine.

DETAILED DESCRIPTION OF EMBODIMENTS OF THE INVENTION

Figure 1:
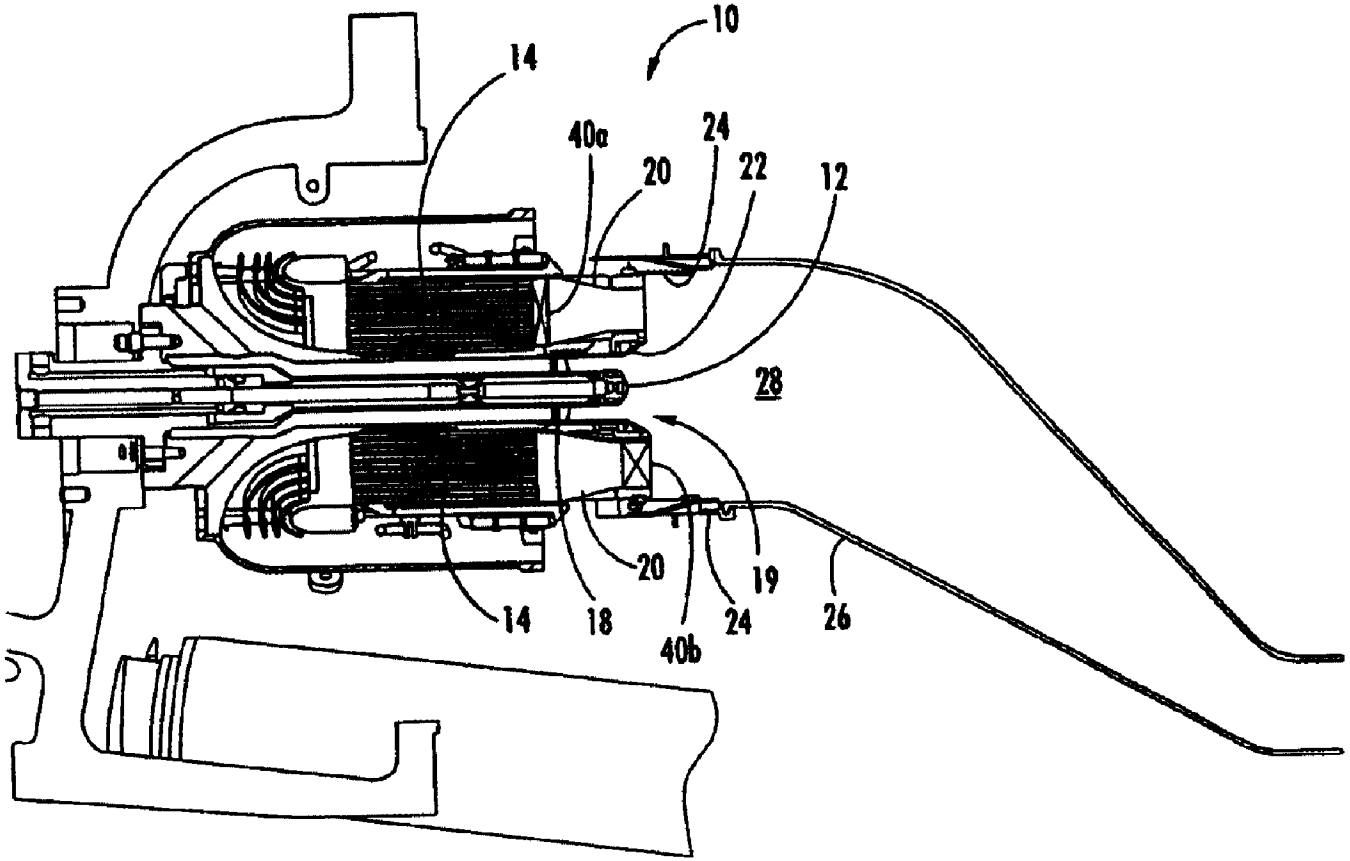
FIG. 1 is an isometric view of a catalytic combustor system according to aspects of the invention.
Figure 2:
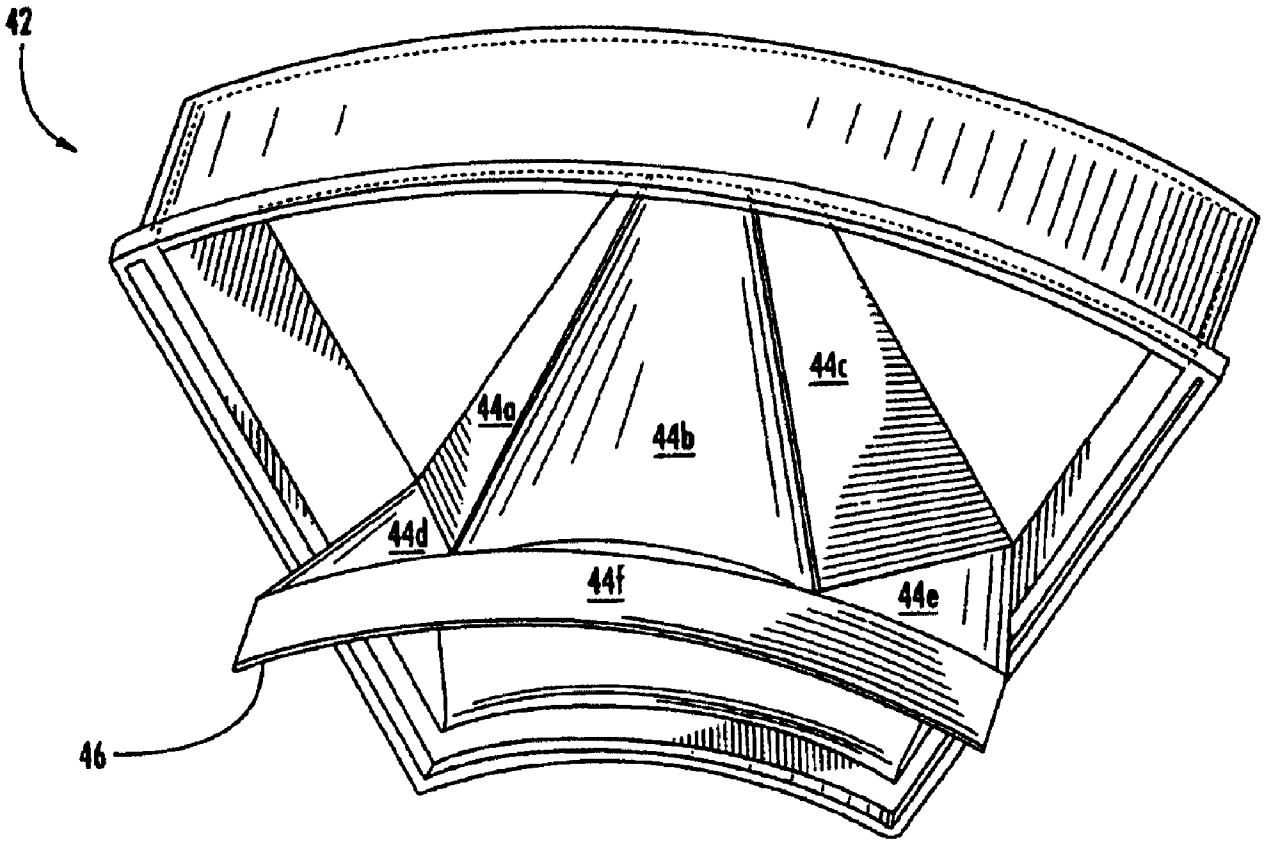
FIG. 2 is an isometric view of a lobe mixer according to aspects of the invention.

Aspects of the present invention relate to catalytic combustion systems and methods for reducing CO emissions in turbine engines having catalytic combustion systems. Embodiments according to aspects of the invention are shown in FIGS. 1–2, but the present invention is not limited to the illustrated structure or application. Further, the following detailed description is intended only as exemplary.

A catalytic turbine engine generally has a compressor section, a catalytic combustor section and a turbine section. One example of a catalytic combustor system 10 according to aspects of the invention is shown in FIG. 1. The basic configuration of the combustor 10 can include a pilot 12 peripherally surrounded by a plurality of catalytic modules 14. In one embodiment, there can be at least six catalytic modules 14 surrounding the pilot 12, which can have an associated nozzle 13. However, there are many alternative combustor configurations. For example, a pilot can be peripherally surrounded by a single catalytic module such as a honeycomb type module (not shown). Alternatively, at least one catalytic module can be peripherally surrounded by one or more pilots (not shown). Other arrangements are possible as will be appreciated by one skilled in the art.

Compressed air from the compressor section of the engine is mixed with fuel and is routed to the combustor section 10. A portion of the air/fuel mixture can flow into the catalytic modules 14 and another portion of the air/fuel mixture can flow into the pilot 12. There are a variety of ways in which the air/fuel mixture can be delivered to each of these portions of the combustor 10, and aspects of the invention are not limited to any particular manner of delivery. In addition, the air/fuel mixture can be achieved in numerous ways as the fuel can be added to the compressed air at various times, stages and places in the combustor. Aspects of the invention encompass all air/fuel mixing techniques and are not limited to any particular system.

The portion of the air/fuel flowing into the pilot 12 can be ignited by and accelerated through the combustor by the pilot 12. Further, the pilot 12 can provide a flame source at higher loads. A swirler 18 can be provided upstream of the pilot exit 19 so that the compressed air and fuel can be thoroughly mixed.

As noted above, a portion of the compressed air/fuel mixture can be supplied to the at least one catalytic module 14. The module 14 can provide one or more passages through which the mixture can flow. As the mixture flows through the module 14, one or more catalysts can be introduced to the mixture by direct injection or other techniques. For example, the walls and/or passages of the module 14 can be coated with catalyst agents such that the catalysts are imparted onto the passing flow, as is known in the art. In many respects, the catalytic modules 14 act like pre-igniters as they begin the reaction, but most of the oxidation occurs downstream of the module 14. After exiting the catalytic modules 14, the flow can be passed through a nozzle 20 at the module exit 14 to avoid the hot gases of the pilot cone 22.

As is typical of catalytic reactors, the catalytic modules 14 tend to laminarize the catalytic flow exiting the module 14 and flowing along the inner walls of the liner 24 and/or transition duct 26. In other words, the modules 14 can remove bulk motion from the catalytic flow. Thus, when the catalytic flow finally comes in contact with the pilot flow, the flame has to burn slowly across the flow as there is no secondary motion. This is a slow process as turbulent flame speed is about 10 meters per second and is sensitive to mixture strength and the entire residence time of the flow in the transition is about 10 milliseconds. Because of size limitations on the length of the transition 26 and with the mixture strengths desired for emission reasons, burnout before the exit of the transition 26 is difficult to achieve. As a result, CO levels are high even at base load and rapidly become worse at lower loads.

Aspects of the invention relate to the placement of one or more vortex forming devices 40 substantially within a least a portion of the catalytic flow path. More particularly, the vortex forming devices 40 can be positioned substantially at the exit of each catalytic module or downstream of the exit of each catalytic module. In one embodiment, one or more vortex forming devices 40 can be positioned anywhere downstream of the catalytic module exit, yet upstream of the main combustion chamber 28. In another embodiment, at least a portion of at least one of the vortex formation devices 40 can extend into the main combustion chamber 28 so long as the at least one vortex forming device 40 is shielded in some manner from any flame. The vortex forming devices 40 can be positioned so as to be completely submerged in the path of the flow exiting the catalytic module 14, preferably such that the devices 40 cannot be touched by any flame. Regardless of their actual position, the vortex formation devices 40 are positioned so as to generate vortices in the flow stream exiting at least one of the one or more catalytic modules 14. The vortices in the flow path can create a suction effect such that at least a portion of the relatively hotter gases from the pilot flow are drawn into the catalyst flow.

Use of the term vortex herein, such as in connection with a vortex forming device 40 or a vortex in the catalytic flow, is merely for convenience and is not intended to limit the scope of the invention to only vortices. For example, in addition to generating one or more vortices, the vortex formation devices 40 can be used to impart any secondary motion or other forces, such as shear forces, in the catalyst flow so as to create turbulence to promote mixing of the partially reacted catalyst flow and the at least partially reacted pilot flow downstream of the device 40.

The temperature of the catalyst flow can be substantially less than the temperature of the pilot flow. Due to the mixing of the flows, heat is introduced to the catalyst flow and this heat input can accelerate the rate at which the catalytic reaction occurs. As a result, the overall flame length of the catalytic flow shortens and a greater portion of the CO generated during combustion can be burnt-out.

The vortex forming devices 40 can be any device that can create vortices in the partially reacted catalytic flow downstream of the catalytic modules 14 or any device that can disturb the otherwise substantially laminar flow out of the catalytic modules 14. For example, the vortex formation devices 40 can be any kind of mixer swirler, or vortex generator. The vortex forming devices 40 can have any of a number of features and attributes. Preferably, the vortex forming device 40 is a low loss mixer, particularly a low pressure loss mixer. That is, it is preferred if the vortex generation device 40 is efficient in forming turbulence or otherwise imparting bulk motion in the catalyst flow without causing a substantial or appreciable pressure loss.

It is also preferred if the vortex forming device 40 does not have any surfaces on which to hold a flame, that is, substantially all of the surfaces are aerodynamically smooth and substantially no area is normal to the direction of the flow. In other words, the majority of the surfaces of the devices are substantially oblique to the direction on the oncoming flow. Such a configuration is preferable in cases of flashback because the excessive temperatures of the pilot zone 19 could destroy the vortex formation device 40 and possibly the catalytic combustor 10 hardware as well. Further, such a configuration diminishes the opportunity for any portion of the flow to stagnate near the device 40.

One example of a vortex formation device 40 according to aspects of the invention is shown in FIG. 2, which depicts a lobe mixer 42. Substantially all of the surfaces 44*a*,44*b*, 44*c*,44*d*,44*e* of the lobe mixer 42 are substantially oblique to the direction of the catalytic flow, except for at least a portion of the front edge surface 44*f*. The front edge surface 44*f*, however, can include a chamfer 46 to diminish the potential for this surface to hold a flame.

In non-catalytic combustors, vortex generation devices 40 cannot be placed at the exit or otherwise downstream of the combustor because the extremely high temperatures would destroy the devices. However, due to the relatively low temperature of the flow exiting the catalytic modules 14, vortex generators can be placed substantially within the catalytic flow. Further, catalytic flow temperatures are below the melting point of many metals such as Hast-X. Thus, the vortex forming devices 40 can be made from any of a number of relatively inexpensive materials.

There can be any number of vortex forming devices 40 associated with each individual catalytic module 14. Further, not every catalytic module 14 needs to have a vortex forming device 14 associated with it, not must the same vortex forming devices 40 be used in connection with different modules. The vortex forming devices 40 can be a variety of heights. While the devices 40 do not need to be the full height of the catalytic module exit, experience has proven that the devices 40 work especially well when they are about at least 50% of the height of the catalytic module exit. Any height can be used so long as a vortex is formed so as to draw at least a portion of the pilot flow into the catalyst flow and so long as the pilot/catalyst flow can expand to scour the surface of the liner and/or transition. The height of the vortex formation devices 40 can vary depending on the desired flame length. Thus, the shape of the flame can be tailored in accordance with aspects of the invention by providing different vortex forming devices 40 in the catalyst flow. The vortex formation devices 40 can be held in place by any of a number of methods such as by fasteners, interference fit, welding, and/or brazing.

In operation, there are at least two flow paths leaving the catalytic combustor 10 and traveling through the transition duct 26. There is a pilot flow path and a catalyst flow path. The catalyst flow path can actually comprise multiple flow paths, one path for each catalytic module 14 surrounding the pilot nozzle 12. Flow in the catalytic paths generally is substantially laminar and follows the walls of the transition 26. One or more catalyst flow paths can be substantially peripherally adjacent to and surround a pilot flow path. Alternatively, one or more pilot flow paths can be substantially peripherally adjacent to and surround a catalyst flow path. While there can be some turbulent flow in the pilot flow path due to the swirlers 18 provided in the upstream portions of the pilot nozzle 12, there is very little bulk motion in the catalytic flow path as discussed above. Thus, there is little mingling of the flow paths as they travel through the transition 26.

The temperature of the catalytic flow is substantially less than the temperature of the pilot flow. Further, the catalytic flow can contain an air/fuel mixture as well as any of a number of catalyst agents. The catalyst flow can be partially reacted. For example, the amount of flow that is reacted as the flow exiting the catalytic module can be about 25%. Similarly, the pilot flow can include an air/fuel mixture that it at least partially reacted, In some area, portions of the pilot flow may be fully reacted. Again, in the case of the pilot flow, the fuel/air mixture is reacted by a pilot flame.

Placement of vortex generators 40 in the substantially laminar catalyst flow path can cause a wake or other turbulence in the catalytic flow path such that bulk motion in the flow is encouraged. Thus, the walls of the liner and/or transition duct can be scavenged. Further, the vortices in the catalytic flow path can result in the mixing of the two flow paths. That is, at least one vortex can formed in at least a portion of the catalytic flow and sufficiently proximate to the pilot flow so that at least a portion of the pilot flow is drawn into and mixes with at least a portion of the catalytic flow. Because the pilot flow path is hotter than the catalyst flow path, the heat input can accelerate burnout reaction. Moreover, the hot pilot gases provide a second source of flame. All of the above facilitate CO burnout.

A catalytic combustor system 10 according to aspects of the invention can provide several advantages over previous catalytic combustion systems. For example, more rapid flame propagation can be experienced in catalytic combustor systems 10 according to aspects of the invention. In addition to shortening the flame length, aspects of the invention can allow for the turning of flame length so as to optimize of emissions, heat transfer and turndown. Further, testing has revealed that a catalytic combustor system 10 according to aspects of the invention can experience reduced dynamics.

Aspects of the invention can be applied to a variety of catalytic combustion systems. For example, aspects of the invention can be applied to rich catalytic systems and well as lean catalytic systems. Further, any type of combustor such as can, annular and hybrid configurations. It will of course be understood that the invention is not limited to the specific details described herein, which are given by way of example only, and that various modifications and alterations are possible within the scope of the invention as defined in the following claims.

What is claimed is:

1. A catalytic combustor system for a turbine engine comprising:

at least one pilot nozzle providing a first flow exiting the pilot nozzle;

at least one catalytic module providing a second flow exiting the at least one catalytic module, wherein at least a portion of the second flow is substantially adjacent to at least a portion of the first flow; and at least one vortex forming device positioned substantially within the path of the second flow, wherein at least one vortex is formed in at least a portion of the second flow, wherein the at least one vortex forming device includes a plurality of surfaces, wherein a substantial majority of the surfaces are substantially oblique to the path of the second flow, whereby at least a portion of the first flow mixes with at least a portion of the second flow.

2. The system of claim 1 wherein the vortex forming device includes a substantially pyramidal portion, wherein the pyramidal portion is substantially centrally located.

3. The system of claim 2 wherein the pyramidal portion includes at least three oblique surfaces facing the second flow.

4. The system of claim 3 wherein at least one of the oblique surfaces has a concave surface.

5. The system of claim 2 wherein the pyramidal portion includes an arcuate base.

6. The system of claim 5 wherein the arcuate base includes at least three oblique surfaces facing the second flow.

7. The system of claim 2 wherein the pyramidal portion is substantially surrounded by a frame matching at least a portion of the area of the second flow.

8. The system of claim 1 wherein the vortex forming device is stationary.

9. A catalytic combustor system for a turbine engine comprising:

a pilot nozzle providing a pilot flow exiting the pilot nozzle;

a plurality of catalytic modules substantially peripherally surrounding the pilot nozzle, a module flow exiting each of the plurality of catalytic modules to collectively form a catalytic flow, wherein the catalytic flow substantially surrounds the first flow; and a plurality of vortex forming devices, each vortex forming device being operatively positioned substantially within the path of each module flow such that at least one vortex is formed in at least a portion of each catalytic flow, whereby at least a portion of the pilot flow mixes with at least a portion of the catalyst flow, wherein at least one of the plurality of vortex forming devices is different from the other vortex forming devices, whereby the different vortex generator forms a different vortex in the catalytic flow, whereby the combustion flame is shaped based on the vortex forming devices selected.

10. A catalytic combustor system for a turbine engine comprising:

a pilot nozzle providing a pilot flow exiting the pilot nozzle;

a first and second catalytic module operatively positioned proximate the pilot nozzle, a catalytic flow exiting each of the plurality of catalytic modules, wherein at least a portion of each catalytic flow is substantially adjacent to at least a portion of the first flow; and a vortex forming device operatively positioned substantially within the path of the catalytic flow of the first catalytic module such that at least one vortex is formed therein, whereby at least a portion of the pilot flow mixes with at least a portion of the catalytic flow of the first module, wherein the catalytic flow exiting the second catalytic module is substantially undisturbed, whereby the combustion flame is shaped by selective association of the vortex forming device with the catalytic modules.

11. A catalytic combustor system for a turbine engine comprising:

a pilot nozzle providing a first flow exiting the pilot nozzle;

a catalytic module providing a second flow exiting the catalytic module, wherein at least a portion of the second flow is substantially adjacent to at least a portion of the first flow, the catalytic module having an exit; and a vortex forming device positioned substantially within the path of the second flow, wherein the vortex forming device is sized so at least about 50 percent and less than 100 percent of the second flow operatively engages the vortex forming device, wherein at least one vortex is formed in at least a portion of the second flow, whereby at least a portion of the first flow mixes with at least a portion of the second flow.

12. A method for reducing CO emissions in a catalytic combustor for a turbine engine comprising the steps of:

providing a turbine engine having a catalytic combustor system, wherein the catalytic combustor includes at least one pilot nozzle and at least one catalytic module;

passing a first mixture of fuel and air through the at least one catalytic module such that a catalyst is introduced to the first mixture, the catalyst commencing a combustion reaction with the mixture, wherein the flow exiting each of the catalytic modules forms a catalytic flow stream having a catalytic temperature;

passing a second mixture of fuel and air through the pilot nozzle such that at least a portion of the second mixture is ignited, wherein the flow exiting the pilot nozzle forms a pilot flow stream having a pilot temperature, wherein the pilot temperature is greater than the catalytic temperature;

ducting the pilot flow stream and the catalytic flow stream away from the at least one pilot nozzle and the at least one catalytic module, wherein the pilot flow stream and the catalytic flow stream remain substantially unmixed; and creating at least one first vortex in a first portion of the catalytic flow stream, wherein the first vortex causes at least a portion of the pilot flow stream to mix with at least a portion of the catalytic flow stream, creating a second vortex in a second portion of the catalytic flow stream, wherein the second vortex is substantially different from the first vortex, wherein the second vortex causes at least a portion of the pilot flow stream to mix with at least a portion of the catalytic flow stream, whereby the different vortices are used to selectively shape the combustion flame, whereby the hotter pilot flow stream accelerate the burn-out reaction in the catalytic flow stream and further shortens the combustion flame length so as to reduce carbon monoxide emissions from the turbine engine.

* * * * *